US006302113B1

(12) United States Patent
Ozeray et al.

(10) Patent No.: US 6,302,113 B1
(45) Date of Patent: Oct. 16, 2001

(54) APPARATUS FOR MAKING FILTER CIGARETTES

(75) Inventors: Phileffe Ozeray, Vaumoise; Robert Calvairac, Lisses, both of (FR)

(73) Assignee: Decouflés.a.r.l., Chilly-Mazarin (FR)

( * ) Notice: Subject to any disclaimer, the term of this patent is extended or adjusted under 35 U.S.C. 154(b) by 0 days.

(21) Appl. No.: 09/417,755

(22) Filed: Oct. 14, 1999

(30) Foreign Application Priority Data

Oct. 14, 1998 (DE) ..... 198 47 337

(51) Int. Cl.[7] ..... A24C 5/10; A24C 5/47
(52) U.S. Cl. ..... 131/94; 131/27.1; 131/29
(58) Field of Search ..... 131/94, 27.1, 29, 131/280, 58, 61.1

(56) References Cited

U.S. PATENT DOCUMENTS

| | | | | |
|---|---|---|---|---|
| 3,176,694 | * | 4/1965 | Kaeding | 131/94 |
| 4,023,577 | * | 5/1977 | Preston et al. | 131/94 |
| 4,969,551 | | 11/1990 | Heitmann et al. . | |
| 5,135,008 | | 8/1992 | Oesterling et al. . | |
| 5,474,091 | | 12/1995 | Draghetti et al. . | |
| 5,632,285 | | 5/1997 | Dahlgrün . | |
| 5,887,595 | | 3/1999 | Draghetti et al. . | |

FOREIGN PATENT DOCUMENTS

| | | |
|---|---|---|
| 195 07 395 | 9/1996 | (DE) . |
| 195 07 395 A1 | 9/1996 | (DE) . |
| 457033 | 11/1936 | (EP) . |
| 0 867 127 A1 | 9/1998 | (EP) . |

* cited by examiner

*Primary Examiner*—Stanley S. Silverman
*Assistant Examiner*—Dionne A. Walls
(74) *Attorney, Agent, or Firm*—Venable; George H. Spencer; Robert Kinberg

(57) ABSTRACT

Groups of coaxial plain cigarettes and filter mouthpieces, particularly cigarettes and mouthpieces having elliptical cross-sectional outlines, carry adhesive-coated uniting bands at the time of entry into a channel between the peripheral rolling surface of a rotary drum and the complementary rolling surface of a stationary rolling member. The uniting bands are convoluted around portions of or the entire mouthpieces and around the neighboring portions of the respective cigarette or cigarettes. The inlet of the channel is defined or preceded by a transversely extending stationary group-contacting device having a raised first portion which cooperates with the drum to set the mouthpieces and the cigarettes of successive oncoming groups into simultaneous rolling motion, and such first portion is followed by a second portion having a concave guide surface which ensures predictable entry of successive groups into the rolling channel downstream of the first portion. The one and/or the other rolling surface and/or the guide surface is or can be grooved to ensure a more predictable rolling of groups in the channel.

25 Claims, 3 Drawing Sheets

APPARATUS FOR MAKING FILTER CIGARETTES

CROSS-REFERENCE CROSS-REFERENCE TO RELATED CASES

This application claims the priority of German patent application Serial No. 198 47 337.0 filed Oct. 14, 1998. The disclosure of the German patent application, as well as that of each U.S. and foreign patent and patent application mentioned in the specification of the present application, is incorporated herein by reference.

BACKGROUND OF THE INVENTION

The invention relates to improvements in apparatus for connecting rod-shaped commodities end-to-end, and more particularly to improvements in apparatus which can be utilized with advantage as filter tipping machines wherein successive groups or arrays each consisting of two or more rod-shaped smokers' products are joined end-to-end by so-called uniting bands, such as adhesive-coated pieces or patches of cigarette paper, artificial cork or other forms or types of so-called tipping paper.

It is well known to make filter cigarettes of unit length by placing a plain cigarette of unit length end-to-end with a filter mouthpiece of unit length and by thereupon connecting the two rod-shaped articles to each other by means of a uniting band which is convoluted around a portion of or around the entire filter mouthpiece as well as around the adjacent end portion of the plain cigarette. Pairs of filter cigarettes of unit length can be produced by placing a filter mouthpiece of double unit length between two plain cigarettes of unit length, by draping an adhesive-coated uniting band around the entire mouthpiece and around the neighboring end portions of the two plain cigarettes, and by thereupon severing the resulting filter cigarette of double unit length midway across the tubular wrapper, i.e., midway across the converted uniting band.

Similar or identical procedures and apparatus can be resorted to for the making of filter cigars, cigarillos or other types of filter tipped smokers' products.

The making of filter cigarettes having an elliptical cross-sectional outline (i.e., of the so-called oval cigarettes) is analogous, except that the apparatus or units for draping uniting bands around groups of neighboring oval plain cigarettes and filter mouthpieces having elliptical cross-sectional outlines are somewhat more complex because the draping unit of such filter tipping machine must cause the elongated oval cigarettes and the aligned oval filter mouthpieces to roll about their respective longitudinal axes by resorting to a more complex wrapping or rolling mechanism. Reference may be had to published German patent application Serial No. 195 07 395 A and to the corresponding U.S. Pat. No. 5,632,285 granted May 27, 1997 to Dahlgrün for "APPARATUS FOR MAKING FILTER TIPPED SMOKERS' PRODUCTS HAVING A NON-CIRCULAR CROSS-SECTIONAL OUTLINE".

The '285 patent to Dahlgrün discloses a filter tipping machine wherein successive groups or arrays of plain oval cigarettes and oval filter mouthpieces are admitted into an arcuate rolling channel between the peripheral surface (first rolling surface) of a rotary drum-shaped first rolling member and a second rolling surface provided on a stationary or mobile second rolling member. A stationary strip- or rail-shaped device is provided at the inlet of the rolling channel to ensure or to render it more likely that all constituents of the arrays or groups entering the rolling channel by moving sideways are compelled to begin to turn about their own axes simultaneously and immediately upon entering the inlet of the rolling channel. This ensures, among other advantages, that each uniting band is more reliably convoluted around the abutting ends of rod-shaped commodities (oval cigarettes and oval filter mouthpieces) during travel of successive groups or arrays through a relatively short rolling channel. In most instances, a filter tipping machine is designed to make successive pairs of filter cigarettes by assembling rod-shaped groups or arrays in each of which a filter mouthpiece of double unit length is placed between and is connected, end-to-end, with the neighboring end portions of two plain cigarettes (oval or cylindrical) of unit length.

The purpose of the aforementioned stationary strip- or rail-shaped device (which may but need not be affixed to the second rolling member) is to considerably enhance the likelihood of the establishment of a properly configurated (eye-pleasing) and at least substantially impervious seal between the abutting filter mouthpiece and plain cigarette or cigarettes. This is accomplished by the aforementioned expedient that the strip- or rail-shaped device ensures that the rolling of all constituents of each group or array entering the rolling channel begins at the same time.

OBJECTS OF THE INVENTION

An object of the instant invention is to provide an apparatus which is even more reliable than the patented apparatus of Dahlgrün, particularly as concerns the treatment of the rod-shaped constituents and the adhesive-coated uniting band(s) of a group during and immediately subsequent to entry into the rolling channel.

Another object of the invention is to provide an apparatus, such as a filter tipping machine, which is particularly suited for predictable making of short or long series of eye-pleasing and properly assembled oval cigarettes.

A further object of the invention is to provide the apparatus with novel and improved means for controlling the movements of successive groups or arrays of coaxial rod-shaped constituents and one or more uniting bands in the region of the aforediscussed strip- or rail-shaped rotation initiating and synchronizing device at the inlet of the rolling channel in apparatus of the type disclosed in the '285 patent to Dahlgrün.

An additional object of the invention is to provide a novel and improved method of making high-quality oval filter cigarettes.

Still another object of the invention is to provide an apparatus which can be installed in, and/or can form part of, new filter tipping machines as well as in existing filter tipping machines for all kinds of filter-tipped smokers' products including oval cigarettes, cigars, cigarillos and the like.

A further object of the invention is to construct, assemble, configurate and finish various group-contacting constituents of a filter tipping machine in such a way that their influence upon the movements and/or other parameters of groups or arrays of rod-shaped articles in a filter tipping or an analogous machine does not change, or does not change appreciably, in response to wear on continuous extensive use of a filter tipping or an analogous machine.

Another object of the invention is to provide an apparatus, such as a filter tipping machine, which can turn out high-quality products (such as filter tipped cigarettes having an elliptical cross-sectional outline) at a rate required in a modern high-speed production line.

An additional object of the invention is to provide a novel and improved method of finishing the product-contacting surface or surfaces of one or more constituents of the above outlined apparatus in such a way that, where and/or when required, the surface or surfaces cannot slip relative to the product or products and vice versa.

Still another object of the invention is to provide rod-shaped products which are produced in accordance with the method and/or in the apparatus of the present invention.

SUMMARY OF THE INVENTION

The invention is embodied in an apparatus for making filter cigarettes or analogous products by connecting to each other rod-shaped commodities which form groups of aligned (particularly coaxial) commodities having neighboring end portions connectable to each other by adherent (i.e., adhesive-coated) uniting bands (such as bands made of cigarette paper, artificial cork or other tipping paper) to be convoluted around the neighboring end portions. The improved apparatus comprises a mobile rolling member having a first rolling surface, and a second rolling member having a second rolling surface defining with the first rolling surface a rolling channel. The mobile rolling member is arranged to advance successive groups of a series toward and into and along the rolling channel with attendant rolling of uniting bands around the neighboring end portions of the respective commodities. The apparatus further comprises a group-contacting device which is disposed at the inlet of the rolling channel and includes a first portion serving to induce simultaneous rolling (namely simultaneous rolling relative to the two rolling surfaces) of all commodities of successive groups being advanced toward the inlet. The group-contacting device further includes a second portion which serves to guide successive groups from the first portion of such device into the rolling channel. The two portions of the group-contacting device can be of one piece or they can constitute two separately produced parts which are thereupon connected to each other or are simply placed next to or relative to each other in such positions that each portion can perform its intended function.

As already mentioned above, the improved apparatus can constitute or it can form part of a filter tipping machine. If the improved apparatus is used as a filter tipping machine, each group of aligned commodities can comprise at least one rod-shaped smokers' product (e.g., a plain cigarette of unit length or multiple unit length) at least one rod-shaped filter mouthpiece for tobacco smoke having an end portion adjacent an end portion of the smokers' product, and at least one uniting band adhering at least to the end portion of the at least one filter mouthpiece and to the end portion of the smokers' product. It is equally possible to form pairs of filter cigarettes by forming groups wherein a filter mouthpiece of double unit length is placed between two coaxial plain cigarettes of unit length and the uniting band is dimensioned to be converted into a tube which surrounds the entire filter mouthpiece of double unit length and the adjacent end portions of the two plain cigarettes of unit length. The thus obtained filter cigarette of double unit length is thereupon severed midway across the tube (converted uniting band) to yield two filter cigarettes of unit length.

The second portion of the group-contacting device (hereinafter called device for short) can be provided with an at least substantially uninterrupted guide surface for successive discrete groups advancing beyond the first portion of the device. The guide surface can constitute an at least partially arcuate surface, e.g., an at least partially concave surface. The guide surface can be at least partially roughened to ensure a more accurate guidance of successive groups into and/or beyond the inlet of the rolling channel. Roughening of the guide surface can involve the application of crossing grooves; such grooves can be obtained as a result of treatment with one or more chasing tools.

The first portion of the device can constitute an elongated narrow ridge or ledge or strip extending transversely across the path of successive groups toward and/or into the inlet of the rolling channel and having a toothed, substantially undulate or similarly configurated group-contacting part which is best suited to temporarily hold the adjacent portion of a group against sidewise movement while another portion of the same group is being advanced by the mobile rolling member so that such group is compelled to begin to rotate about its longitudinal axis.

If the commodities of each group have a substantially elliptical cross-sectional outline, the rolling surfaces and the device are configurated to roll the uniting bands around such groups, i.e., around at least a portion of a filter mouthpiece and around the adjacent end portion of an oval cigarette if the apparatus is used as a filter tipping machine.

At least one of the rolling surfaces can be roughened, e.g., in the same way as the aforediscussed guide surface on the second portion of the device (for example, by resorting to one or more chasing tools) It has been found that the rolling properties of the two rolling members can be enhanced to a surprising extent if at least one of the rolling surfaces is provided with several sets of preferably intersecting grooves, for example a first set of parallel grooves which may but need not be parallel to the axes of the groups advancing from the inlet toward the outlet of the rolling channel, and at least one second set of parallel or substantially parallel grooves which are inclined relative to and can intersect the grooves of the first set.

The crossing grooves can together form a network of grooves covering at least a portion of the respective rolling surface or of the guide surface. The network of grooves preferably defines a plurality of raised portions or platforms having minute top lands.

The mobile rolling member can constitute or include a rotary drum having a peripheral surface including or constituting or forming part of the first rolling surface.

The second rolling surface is or can be stationary.

At least one of the rolling surfaces can have an undulate profile, particularly if the apparatus is used to make oval cigarettes.

The grooves in the one and/or the other rolling surface and/or in the guide surface can be shallow or extremely shallow, e.g., they can have a depth of between 0.3 and 1.2 mm. A presently preferred depth is about 0.5 mm.

The novel features which are considered as characteristic of the invention are set forth in particular in the appended claims. The improved apparatus itself, however, both as to its construction and its mode of operation, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
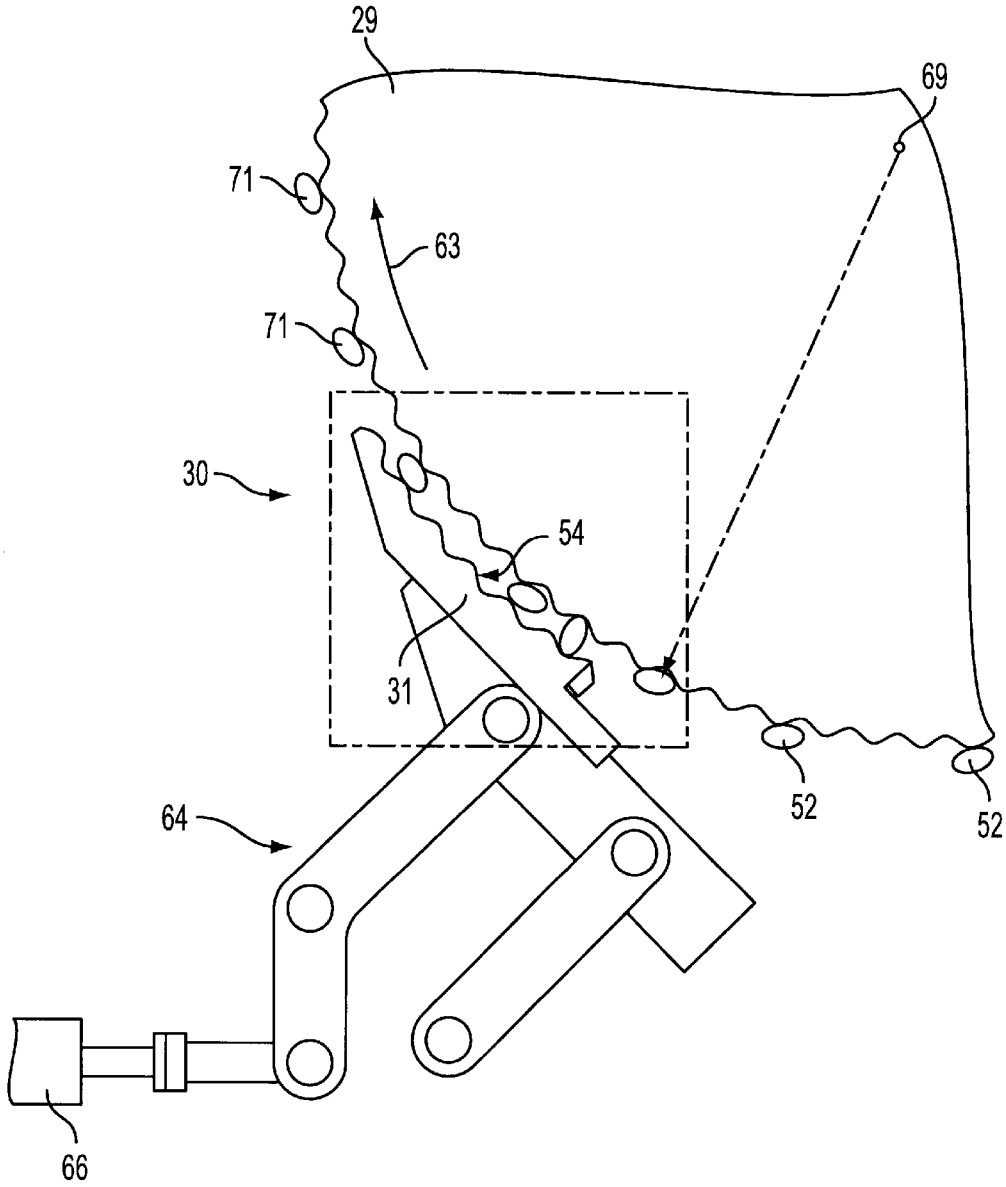
FIG. 1 is a view similar to that in FIG. 2 of the drawings in the '285 patent to Dahlgrün and further shows one form of that portion of a group contacting device which forms part of the invention and controls the movements of successive groups of rod-shaped constituents at the inlet of the rolling channel.

That portion of a filter tipping machine which forms part of or constitutes one embodiment of the improved apparatus 30 is shown in FIGS. 1–3 and 3*a*. With the exception of a group guiding portion or guide 72*a* of a group-contacting device, which latter further includes a strip- or rail-shaped portion 72, the apparatus 30 is or can be identical with or plainly analogous to that shown in FIGS. 2 and 3 of the '285 patent to Dahlgrün. Such apparatus can receive successive groups 52 consisting of aligned (coaxial) rod-shaped constituents or components and at least one adhesive-coated uniting band 53 (only one shown in FIG. 2) from the corresponding part of the machine shown in FIG. 1 of the '285 patent to Dahlgrün.

It is assumed that each group 52 comprises two coaxial plain oval cigarettes of unit length, an oval filter mouthpiece of double unit length between and abutting the two plain cigarettes, and an adhesive-coated sheet-like (non-convoluted) uniting band 53 in linear (tangential) contact with the entire filter mouthpiece as well as with the adjacent inner end portions of the plain cigarettes. It is clear that only one side of each sheet-like uniting band 53 is coated with a suitable adhesive.

When the wrapping operation is completed, the uniting band 53 is rolled around the filter mouthpiece of double unit length as well as around the neighboring end portions of the two plain cigarettes of the thus obtained oval filter cigarette 71 of double unit length; such converted uniting band then forms a tube having an oval cross-sectional outline and being ready to be severed midway between its ends, i.e., the filter cigarette 71 of double unit length is converted into a pair of oval filter cigarettes of unit length which are mirror images of one another because their mouthpieces or filter plugs (of unit length) are adjacent each other.

The apparatus 30 further comprises a mobile first rolling member 29 here shown as a drum driven by a suitable prime mover to rotate (see the arrow 63) about a preferably horizontal axis 69 and having an undulate peripheral (first) rolling surface 62 confronting and complementary to an undulate concave second rolling surface 54 provided on a normally or preferably stationary second rolling member 31 of the apparatus 30.

The drum 29 comprises or constitutes a cylindrical sleeve 56 which is provided with the aforementioned first rolling surface 62 and is rotatable about a stationary shaft 57 constituting a stationary valving member and serving to regulate the retention of successive groups 52 and their uniting bands 53 at the rolling surface 62 during transport of successive groups 52 toward the inlet (at 72) of an arcuate rolling channel 67 between the surfaces 54 and 62. The peripheral surface of the valving member 57 has suitably distributed suction chambers 58 which are connected to a standard suction generating device (e.g., a pump, not shown), and the suction chambers 58 draw air from neighboring orbiting radially extending suction ports 61 extending from the internal surface to the rolling surface 62 of the sleeve 56. The radially outer ends of the ports 61 attract groups 52 on their way toward the strip- or rail-shaped portion 72 of the composite group-contacting device 72, 72*a* of the apparatus 30. The radially outer ends of the suction ports 61 communicate with elongated receptacles or flutes 59 which are provided in the rolling surface 62 and are parallel to the axis 69. Such flutes receive portions of groups 52 during advancement of such groups toward the inlet of the rolling channel 67, i.e., into the range of the portion 72 of the group-contacting device 72, 72*a*.

The rolling member 31 is adjustable relative to the rolling surface 62 by a motor 66 (e.g., a hydraulic or pneumatic double-acting cylinder and piston unit) by way of a suitable linkage 64 (e.g., a parallel motion). For example, the motor 66 will be actuated to move the rolling member 31 away from the sleeve 56 in order to clean the rolling surface 54 and/or to remove groups 52 which are jammed in the channel 67 and/or to remove remnants of damaged or destroyed groups 52 from the rolling channel. Furthermore, the motor 66 will be actuated to adjust the position of the rolling surface 54 relative to the rolling surface 62 in order to ensure an optimal rolling of uniting bands 53 on their way from the inlet to the outlet of the channel 67.

Figure 2:
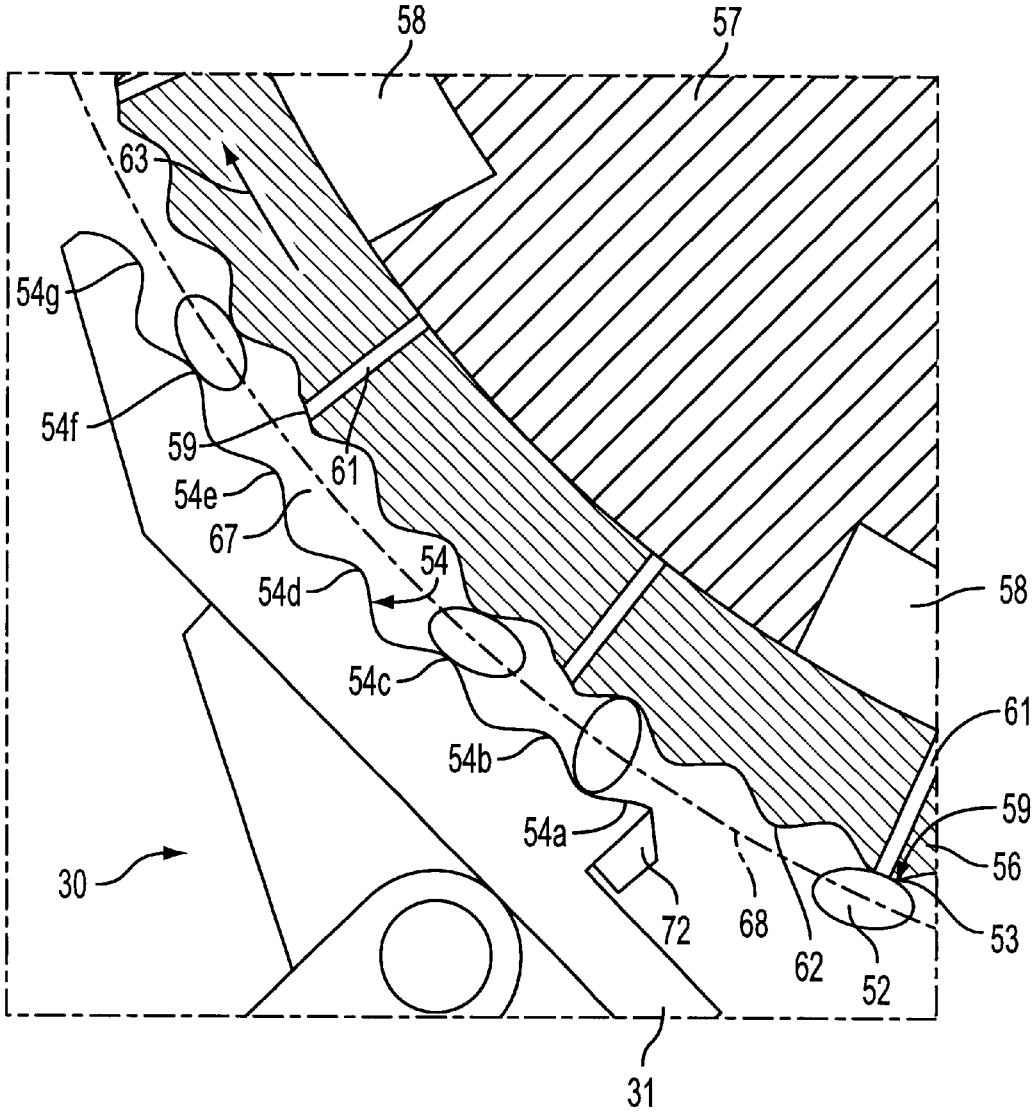
FIG. 2 is a larger-scale partly sectional view of a detail in the structure shown in FIG. 1.
Figure 3A:
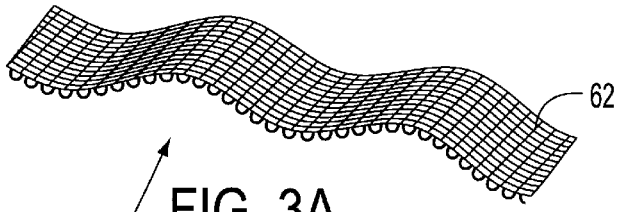
FIG. 3*a* is an expanded view of a portion of one presently preferred first rolling surface within the circle shown in the upper part of FIG. 3.
Figure 3:
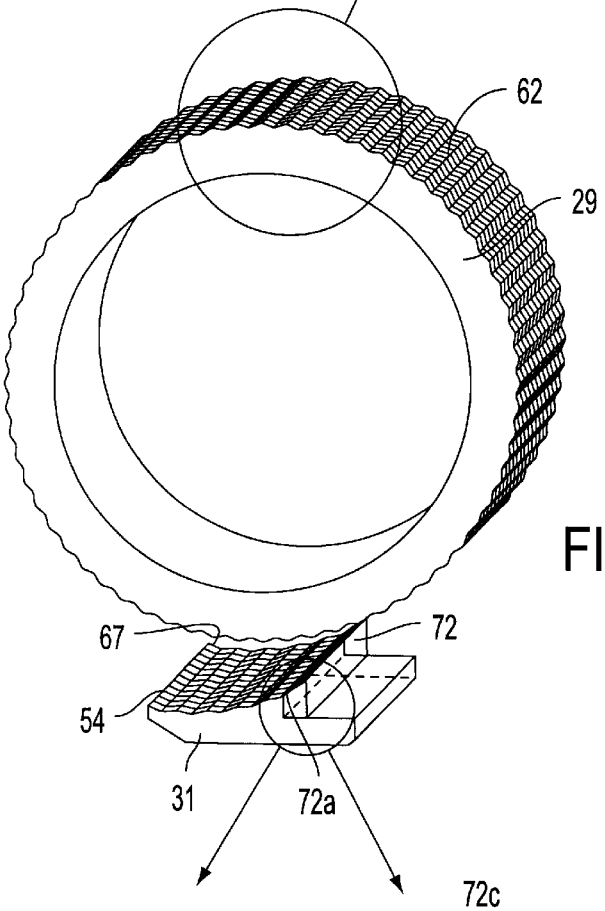
FIG. 3 is a smaller-scale perspective view of the two rolling members and of the group contacting device in the apparatus of FIGS. 1 and 2.

As can be seen in each of FIGS. 1 to 3 (and for the rolling surface 62 also in FIG. 3*a*), each of the rolling surfaces 54, 62 has an undulate shape such as is necessary to ensure reliable rolling of the uniting bands 53 around the rod-shaped constituents of the respective groups 52 when the groups are confined in and advance along the rolling channel 67 due to rotation of the sleeve 56 in the direction of the arrow 63 and also because those suction ports 61 which communicate with the channel 67 are sealed from the suction chambers 58. The configuration of the undulate rolling surfaces 54, 62, the distance of the rolling surface 54 from the axis 69, and the rotational speed of the sleeve 56 in the direction of the arrow 63 are such that successive groups 52 roll in the channel 67 with at least substantially uninterrupted and hence predictable and reliable guidance of the peripheral surfaces of the oval constituents of the groups so that the axes of the groups travel along an arcuate path 68 (indicated by dot-dash lines) having a center of curvature on the axis 69.

The just described mode of compelling the axes of the groups 52 to travel along the arcuate path 68 ensures that the center of gravity of the mass of each group also advances along a predetermined arcuate path (namely that denoted by the arcuate dot-dash line 68 or close thereto) even though the oval constituents of each group 52 turn about their common axis during advancement from the inlet (at 72, 72*a*) toward the outlet (at 54*g*) of the rolling channel 67. The result is that the quality of the filter cigarettes 71 of double unit length emerging from the channel 67 is highly satisfactory, i.e., the mutual axial as well as angular positions of all oval constituents are the same as during advancement (by suction) toward the inlet of the channel 67 (or even more accurate), and each uniting band 53 is converted into a tube having an elliptical cross-sectional outline and closely following the adjacent portions of the external surfaces of the entire filter mouthpiece of double unit length as well as the adjacent end portions of the two plain cigarettes of unit length.

The strip- or rail-shaped portion 72 of the group-contacting device 72, 72*a* is dimensioned, configurated and positioned with a view to ensure a highly satisfactory start of rolling movement of all rod-shaped constituents of each of a short or long series of successive oncoming groups 52. The reasons for this are fully explained in the '285 patent to Dahlgrün. The portion 72 is located at the inlet of the channel 67, i.e., at the upstream end of the rolling surface 54. Actually, the portion 72 can be said to serve as a means for expelling the rod-shaped constituents of the oncoming groups 52 from their respective flutes 59 (in which the groups 52 were held by suction via ports 61) and for simultaneously setting all rod-shaped constituents of the oncoming groups into rotary (rolling) motion.

The lower of the two suction chambers 58 which are shown in FIG. 2 terminates (as seen in the direction of the arrow 63) radially inwardly of the portion 72 so that suction in such chamber 58 cannot interfere with the intended function of the portion 72. Such positioning of the portion 72 relative to the downstream end of the adjacent suction chamber 58 is desirable and advantageous because it contributes to gentle treatment of all parts of the groups 52.

The undulate shapes of the rolling surfaces 54, 62 are selected in such a way that each thereof includes a series of successive identical sections. Moreover, the number of identical sections (54a, 54b, 54*c*, 54*d*, 54*e*, 54*f*, 54*g*) of the rolling surface 54 is or can be selected in such a way that the rod-shaped constituents of each group 52 advancing from the inlet to the outlet of the arcuate rolling channel 67 complete a full revolution or a whole multiple of a full revolution. The free ends of the lead lines for the reference characters 54*a*–54*g* point to the apices of successive hills of the concave undulate rolling surface 54. A group 52 advancing in the channel 67 is compelled to complete several convolutions about the common axis of its rod-shaped constituents because each rolling between the apices of two consecutive hills (e.g., between those denoted by the characters 54*a*–54*b*, 54*b*–54*c*, etc.) involves an angular displacement through 180°. An advancement from 54*a* to 54*e* causes a group 52 to complete two full revolutions about the common axis of its rod-shaped constituents. Each group 52 advancing in the channel 67 from 54*a* and all the way to 54*g* completes three full revolutions.

Repeated rolling of successive groups 52 on their way from the inlet and all the way to the outlet of the channel 67 reliably ensures predictable rolling of the entire uniting bands 56 around the adjacent filter mouthpieces and neighboring end portions of the respective pairs of oval cigarettes, i.e., the appearance of each filter cigarette 71 is highly satisfactory and the quality of the connections between its filter mouthpiece and plain cigarettes is equally satisfactory. Moreover, a suction port 61 catches up with the finished filter cigarette 71 of double unit length when it begins to communicate with the upper suction chamber 58 of FIG. 2 and while such cigarette 71 is in the adjacent flute 59 of the surface 62 so that the rotating sleeve 56 entrains successive filter cigarettes 71 to a transfer station, such as the transfer station between 29 and 32 in FIG. 1 of the '285 patent to Dahlgrün, for advancement to a severing station (33, 34 in FIG. 1 of the '285 patent) where the filter cigarettes 71 of double unit length are halved to yield pairs of identical mirror symmetrical filter cigarettes of unit length. Further processing of such filter cigarettes of unit length is or can be the same as described with reference to FIG. 1 of the '285 patent to Dahlgrün.

FIG. 3 shows the sleeve of the rolling member 29, the undulate peripheral rolling surface 62 of the sleeve, the rolling member 31 and its undulate rolling surface 54, the channel 67 between the rolling surfaces 54, 62, and the group-contacting device including the first portion 72 and a second portion 72*a* with a concave guide surface extending from the portion 72 toward the interior of the channel 67. More specifically, the guide surface of the portion 72*a* slopes from the portion 72, away from the rolling surface 62 and toward the section 54*a* of the rolling surface 54.

As shown in FIGS. 3 and 3*a*, the rolling surface 62 is provided with two sets of shallow grooves or rifles. The grooves of one set are parallel to the axis 69 (i.e., to the axis of the sleeve 56 of the rolling member 29), and the grooves of the other set are parallel to each other and normal to the grooves of the one set. Thus, in the embodiment of FIGS. 3 and 3*a*, the grooves of the other set extend at least substantially circumferentially of the sleeve 56 and are inclined relative to the axes of the rod-shaped constituents of groups 52 in the channel 67 as well as relative to the axes of the rod-shaped constituents of the groups 52 being attracted into the flutes 59 of the rolling surface 62 by the suction ports 61 on their way toward the inlet of the channel 67.

The illustrated sets of parallel or nearly parallel grooves can be formed by resorting to one or more suitable roughening or scratching implements, e.g., to chasing tools (not shown). Furthermore, the rolling surface 62 can be roughened by providing it with three or more sets of grooves, and the grooves of any given set may but need not be parallel to each other. Sets of parallel grooves are often preferred on the ground that they can be provided in the surface 62 by resorting to one or more relatively simple tools and in a time-saving manner. In their entirety, the two sets of grooves in the rolling surface 62 form a network which covers (but need not always cover) the entire rolling surface and defines a relatively large number of raised portions or platforms having relatively small (and hereinafter referred to as minute) identical or differently dimensioned and/or configurated top lands or faces. An advantage of such design and/or finish of the rolling surface 62 is that it can reliably engage the external surface of a group 52, without causing any scoring or other optical or mechanical damage to the constituents of the group, with the result that the rolling of the uniting bands 53 around the rod-shaped constituents of the respective groups 52 takes place in a highly predictable and reproducible fashion. In other words, the minute top faces or lands of the raised portions defined by the network or networks of crossing sets of grooves in the rolling surface 62 of the sleeve 56 prevents or minimizes slippage of the components of the group 52 relative to the conveyor 29.

It has been found that the grooves can fulfill their intended purpose (particularly to prevent any slippage or excessive slippage of the groups 52 relative to the sleeve 56) even if they are rather shallow or very shallow. A satisfactory depth is between about 0.3 and 1.2 mm, especially about 0.5 mm.

It was further ascertained that the grooves in the rolling surface 62 meet their purpose even if none of the grooves are parallel to the axis 69 and/or even if the grooves of one set are not normal (or even close to normal) to the grooves of any other set.

Another important advantage of the grooves and of the resulting elimination or reduction of slippage between the rolling surface 62 and the external surfaces of the groups 52 is that the rolling of the groups in the channel 67 necessitates the application of lesser or weaker forces which exerts a beneficial influence upon one or more parameters (such as the hardness) of the filter cigarettes 71.

For the sake of clarity, the flutes (59) in the rolling surface 62 shown in FIGS. 3 and 3*a* are not as pronounced as in FIG. 2.

As shown in FIG. 3, the rolling surface 54 of the rolling member 31 can be provided with two or more sets of grooves similar to, identical with or different from those shown in the rolling surface 62 of the sleeve 56 of the rolling member 29. The same holds true for the concave guide surface of the portion 72*a* of the group-contacting device 72, 72*a*. The provision of grooves in the rolling surface 54 further reduces the likelihood of slippage between the external surfaces of the groups 52 and the rolling surfaces 54, 67 during advancement of the groups in the rolling channel 67. An advantage of grooves in the guide surface of the portion 72*a* is that the advancement of successive groups 52 from the portion 72 toward engagement with the rolling surfaces 54, 62 at the inlet of the channel 67 is even more predictable.

The provision of grooves or analogous unevennesses in the rolling surfaces is equally advantageous if they are provided in surfaces for the rolling of cylindrical groups, i.e., in connection with the making of standard filter cigarettes, cigarillos or cigars having tobacco-containing portions and filter material-containing portions (mouthpieces) with a circular or substantially circular cross-sectional outline. Filter tipping machines of such character (i.e., for the making of standard non-oval filter cigarettes) are disclosed, for example, in U.S. Pat. No. 5,135,008 granted Aug. 4, 1992 to Oesterling et al. for "METHOD OF AND APPARATUS FOR MAKING FILTER CIGARETTES". Reference may also be had to U.S. Pat. No. 4,969,551 granted Nov. 13, 1990 to Heitmann et al. for "METHOD OF AND APPARATUS FOR ROLLING ROD-SHAPED ARTICLES". It has been found that the advantages of sets and/or networks of grooves and raised portions or platforms defined by intersecting grooves are just as apparent when the rolling mechanism for uniting bands is employed in a machine for the making of circular (standard) filter cigarettes.

Figure 4:
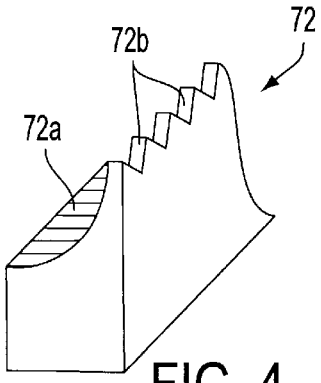
FIG. 4 is an enlarged fragmentary perspective view of that portion of the group-contacting device which is encircled in the lower part of FIG. 3 and embodies one form of the invention.
Figure 5:
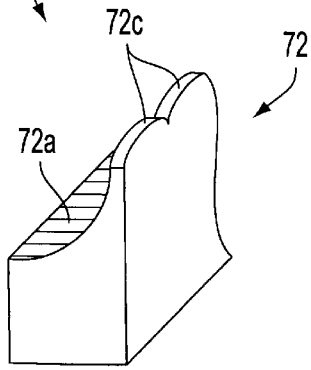
FIG. 5 is a similar view of a portion of a modified group-contacting device.

The strip- or rail-shaped portion 72 of the novel group-contacting (combined movement synchronizing and group guiding) device 72, 72*a* can be provided with a row of teeth 72*b* (FIG. 4) or with a row of undulations or rounded projections (scallops) 72*c* (FIG. 5). The teeth 72*b* or the undulations (scallops) 72*c* extend toward the rolling surface 62 adjacent the inlet of the rolling channel 67, i.e., at the concave guide surface of the portion 72*a*. Such teeth 72*b* and/or undulations (scallops) 72*c* and/or analogous configurations can be formed in a grinding machine or any other suitable material removing machine tool. The just discussed configurations on the portion 72 are desirable in the machines or apparatus for the making of cylindrical as well as for the making of oval filter cigarettes.

The provision of a network or any other suitable array of crossing and/or otherwise distributed grooves in the guide surface of the portion 72*a* is particularly desirable if the rod-shaped constituents of the groups 52 have an elliptical cross-sectional outline. However, and as already mentioned hereinbefore, at least the toothed or scalloped portion (72*b* or 72*c*) and/or the provision of the concave guide surface on the portion 72*a* can be put to use in all kinds of filter tipping machines (for rod-shaped circular or oval (i.e., non-round) filter cigarettes), particularly in machines or apparatus employing the portion 72 (with projections 72*b* or 72*c*), because the surface of the portion 72*a* can also serve as a means for gently and predictably guiding the groups 52 away from the portion 72, i.e., into the inlet of the rolling channel 67. Any dropping or other unpredictable and abrupt departure of groups 52 from contact with the portion 72 could affect the rolling of uniting bands around cylindrical and particularly around oval rod-shaped constituents of filter cigarettes or the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of making filter cigarettes and, therefore, such adaptations should and are intended to be comprehended within the meaning and range of equivalence of the appended claims.

What is claimed is:

1. Apparatus for connecting to each other rod-shaped commodities of groups of aligned commodities having neighboring end portions connectable to each other by adherent uniting bands to be convoluted around the neighboring end portions, comprising:

a mobile rolling member having a first rolling surface;

a second rolling member having a second rolling surface defining with the first rolling surface a rolling channel, said mobile rolling member being arranged to advance successive groups of a series of groups into and along said rolling channel with attendant rolling of uniting bands around the neighboring end portions of the respective commodities, said channel having an inlet and an outlet; and a group-contacting device disposed at said inlet and including a first portion arranged to induce simultaneous rolling, relative to said rolling surfaces, of all commodities of successive groups being advanced toward said inlet, said device further having a second portion arranged to guide successive groups from said first portion into said channel, wherein said second portion of said device has an at least substantially uninterrupted guide surface for successive groups advancing beyond said first portion of said device, and wherein said second portion of said device has an at least partially arcuate guide surface for successive groups advancing beyond said first portion of said device.

2. The apparatus of claim 1, wherein each group of aligned commodities comprises at least one rod-shaped smokers' product, at least one rod-shaped filter mouthpiece for tobacco smoke having an end portion adjacent an end portion of the smokers' product, and at least one uniting band adhering at least to the end portion of the at least one filter mouthpiece and to the end portion of the smokers' product.

3. The apparatus of claim 1, wherein said second portion of said device has an at least partially roughened group-contacting guide surface.

4. The apparatus of claim 3, wherein said guide surface has crossing grooves.

5. The apparatus of claim 3, wherein said guide surface is roughened as a result of treatment with a chasing tool.

6. The apparatus of claim 1, wherein said first portion of said device has a toothed group-contacting part.

7. The apparatus of claim 1, wherein said first portion of said device has a substantially undulate group-contacting part.

8. The apparatus of claim 1, wherein the commodities of each group have a substantially elliptical cross-sectional outline, said rolling surfaces and said device being configurated to roll adherent uniting bands around such groups having substantially elliptical cross-sectional outlines.

9. The apparatus of claim 1, wherein at least one of said rolling surfaces is roughened as a result of treatment with a chasing tool.

10. The apparatus of claim 1, wherein at least one of said rolling surfaces has crossing grooves.

11. The apparatus of claim 10, wherein said grooves include a first set of at least substantially parallel grooves and a second set of substantially parallel grooves inclined relative to the grooves of said first set.

12. The apparatus of claim 10, wherein at least some of said grooves are inclined relative to the longitudinal extensions of commodities in said rolling channel.

13. The apparatus of claim 10, wherein said grooves include a first set of grooves at least substantially parallel to the longitudinal extensions of commodities in said rolling channel and at least one second set of grooves inclined relative to said longitudinal extensions.

14. The apparatus of claim 10, wherein said crossing grooves together form a network of grooves covering at least a portion of said at least one rolling surface.

15. The apparatus of claim 14, wherein the grooves of said network define in said at least one rolling surface a plurality of raised portions having minute top lands.

16. The apparatus of claim 14, wherein the commodities of each group have a substantially elliptical cross-sectional outline, said rolling surfaces and said device being configurated to roll adherent uniting bands around such groups having substantially elliptical cross-sectional outlines.

17. The apparatus of claim 1, wherein said mobile rolling member includes a rotary drum having a peripheral surface including said first rolling surface.

18. The apparatus of claim 17, wherein said first rolling surface has crossing grooves.

19. The apparatus of claim 17, wherein said second rolling surface is stationary.

20. The apparatus of claim 1, wherein said second rolling surface is a grooved stationary rolling surface.

21. The apparatus of claim 1, wherein at least one of said rolling surfaces is a grooved surface.

22. The apparatus of claim 21, wherein the commodities of each group have a substantially elliptical cross-sectional outline, said rolling surfaces and said device being configurated to roll adherent uniting bands around such groups having substantially elliptical cross-sectional outlines.

23. The apparatus of claim 21, wherein said at least one rolling surface has a plurality of grooves at least some of which cross each other, said grooves having a depth of between about 0.3 and 1.2 mm.

24. The apparatus of claim 23, wherein said depth is about 0.5 mm.

25. The apparatus of claim 22, wherein at least one of said rolling surfaces has an undulate profile.

* * * * *